US010981684B2

(12) United States Patent
Resch et al.

(10) Patent No.: US 10,981,684 B2
(45) Date of Patent: Apr. 20, 2021

(54) STRETCH WRAP MONITORING DEVICE

(71) Applicant: Group O, Inc., Milan, IL (US)

(72) Inventors: Richard Resch, Rock Island, IL (US); Alan J. Mindlin, Naperville, IL (US); Richard P. Earl, Bolingbrook, IL (US)

(73) Assignee: Group O, Inc., Milan, IL (US)

( * ) Notice: Subject to any disclaimer, the term of this patent is extended or adjusted under 35 U.S.C. 154(b) by 266 days.

(21) Appl. No.: 15/908,962

(22) Filed: Mar. 1, 2018

(65) Prior Publication Data

US 2018/0257802 A1 Sep. 13, 2018

Related U.S. Application Data

(60) Provisional application No. 62/465,308, filed on Mar. 1, 2017.

(51) Int. Cl.

| | |
|---|---|
| ***B65B 57/02*** | (2006.01) |
| ***B65B 11/04*** | (2006.01) |
| ***B65B 41/16*** | (2006.01) |
| ***B65B 57/18*** | (2006.01) |

(52) U.S. Cl.

CPC ..... *B65B 57/02* (2013.01); *B65B 11/045* (2013.01); *B65B 41/16* (2013.01); *B65B 57/18* (2013.01)

(58) Field of Classification Search

CPC ..... B65B 11/045; B65B 57/02; B65B 57/18; B65B 41/16

See application file for complete search history.

(56) References Cited

U.S. PATENT DOCUMENTS

| | | | | |
|---|---|---|---|---|
| 3,867,806 | A * | 2/1975 | Lancaster, III | B65B 11/045 53/441 |
| 4,248,031 | A * | 2/1981 | Del Pozo, Jr. | B65B 11/045 53/556 |
| 6,185,914 | B1 * | 2/2001 | Mackie | B65B 11/045 53/556 |
| 6,370,839 | B1 * | 4/2002 | Nakagawa | B65B 11/008 52/211 |
| 2006/0131405 | A1 * | 6/2006 | Schneider | B65B 11/045 235/385 |

(Continued)

OTHER PUBLICATIONS

Lantech, Lantech Stretch Wrappers and Case Equipment, Lean Wrap Series, product information located on the Lantech website: www.lantech.com, 2017.

(Continued)

*Primary Examiner* — Andrew M Tecco
*Assistant Examiner* — Nicholas E Igbokwe
(74) *Attorney, Agent, or Firm* — Lane & Waterman LLP

(57) ABSTRACT

A system for monitoring the percentage of stretch of a stretch wrap film in a stretch wrapping machine includes a first sensor associated with the stretch wrap roll and configured to generate a first signal as the film travels from the roll to the pre-stretch roller assembly, and a second sensor associated with the load and configured to generate a second signal as the film is wrapped around the load. A processor is operable to: a) calculate a pre-stretch length of the film based on the first signal during a time interval; b) calculate a stretched length of the film as the film is wrapped around the load on the rotating platform during the time interval; and c) calculate a percentage stretch of the film based on the pre-stretch length and said stretched length.

6 Claims, 7 Drawing Sheets

(56) References Cited

U.S. PATENT DOCUMENTS

| | | | | |
|---|---|---|---|---|
| 2009/0293425 | A1* | 12/2009 | Carter | B65B 11/045 53/167 |
| 2010/0300049 | A1* | 12/2010 | Schmidt | B65B 11/045 53/461 |
| 2012/0102887 | A1* | 5/2012 | Lancaster, III | B65B 11/045 53/461 |
| 2012/0175170 | A1* | 7/2012 | Martin | G01G 19/00 177/201 |
| 2015/0101281 | A1* | 4/2015 | Kudia | B65B 57/12 53/51 |
| 2017/0101205 | A1* | 4/2017 | Schieck | B65B 57/04 |

OTHER PUBLICATIONS

Highlight Industries, Inc., HiLife Film Monitoring System, product information located on the Highlight Industries, Inc. website: www.highlightindustries.com, 2018.

Atlantic Packaging, M.U.S.T. System, product information located on the Atlantic Packaging website: www.atlanticpkg.com, 2017.

* cited by examiner

STRETCH WRAP MONITORING DEVICE

PRIORITY CLAIM AND REFERENCE TO RELATED APPLICATION

This application is a utility filing of and claims priority to U.S. Provisional Application No. 62/465,308, filed on Mar. 1, 2017, the entire disclosure of which is incorporated herein by reference.

BACKGROUND

The present disclosure relates to a monitoring device for a pallet stretch wrapping machine.

Stretch wrap (also called stretch film) is commonly used as a packaging material for many companies that ship goods either on pallets or as stand-alone units. The stretch wrap is applied to the goods for a number of reasons, but generally to contain and protect the load. The stretch wrap is applied such that the film is stretched to a desirable percentage while being applied to the load. Control of the percentage of stretch is important as the stretch film achieves certain desirable characteristics at the appropriate percentage of stretch such as elastic rebound which serves to contain and protect the load.

Most types of stretch wrap machines have pre-stretch rollers that are configured to reduce the rate at which stretch film is fed to the load. In this way, the stretch film is stretched while passing over/through these rollers before application to the load. Over time, the pre-stretch rollers on stretch wrap machines can wear thus affecting the percentage of stretch achieved by the stretch wrap machines. When stretch film is applied to a load at an incorrect percentage of stretch, the amount of material used may be too great and therefore wasteful and expensive. Moreover, the stretch film may not achieve its desired characteristics thereby putting the safety or security of the load in jeopardy. It is desirable therefore, to have continuous and remote monitoring of the percentage of stretch so that any material deviations can be remedied without significant loss or expense.

SUMMARY OF THE DISCLOSURE

A stretch wrapping machine comprises a rotating platform for supporting a load to be wrapped in a stretch wrap film and dispenser mechanism supporting a roll of stretch wrap film and including a pre-stretch roller assembly for receiving the film from the roll and guiding the film to be wrapped around the load supported thereon. A system for monitoring the percentage stretch of the stretch wrap film includes a first sensor associated with the roll and configured to generate a first signal as the film travels from the roll to the pre-stretch roller assembly, and a second sensor associated with the load on the rotating platform and configured to generate a second signal as the film is wrapped around the load and the processor.

A controller includes a processor that is configured and operable to: a) receive the first signal and calculate a pre-stretch length of the film based on the first signal during a time interval; b) receive the second signal and calculate a stretched length of the film as the film is wrapped around the load on the rotating platform during the time interval; c) calculate a percentage stretch of the film based on the pre-stretch length and said stretched length; and d) generate a sensible output based on the calculated percentage of stretch. The processor can compare the calculated percentage of stretch to a pre-determined threshold and generate an alert if the calculated percentage of stretch falls outside the threshold. The system can include a communications device for communicating the alert and/or information regarding the percentage stretch of the film as it is being wound around a load.

DETAILED DESCRIPTION

Figure 1:
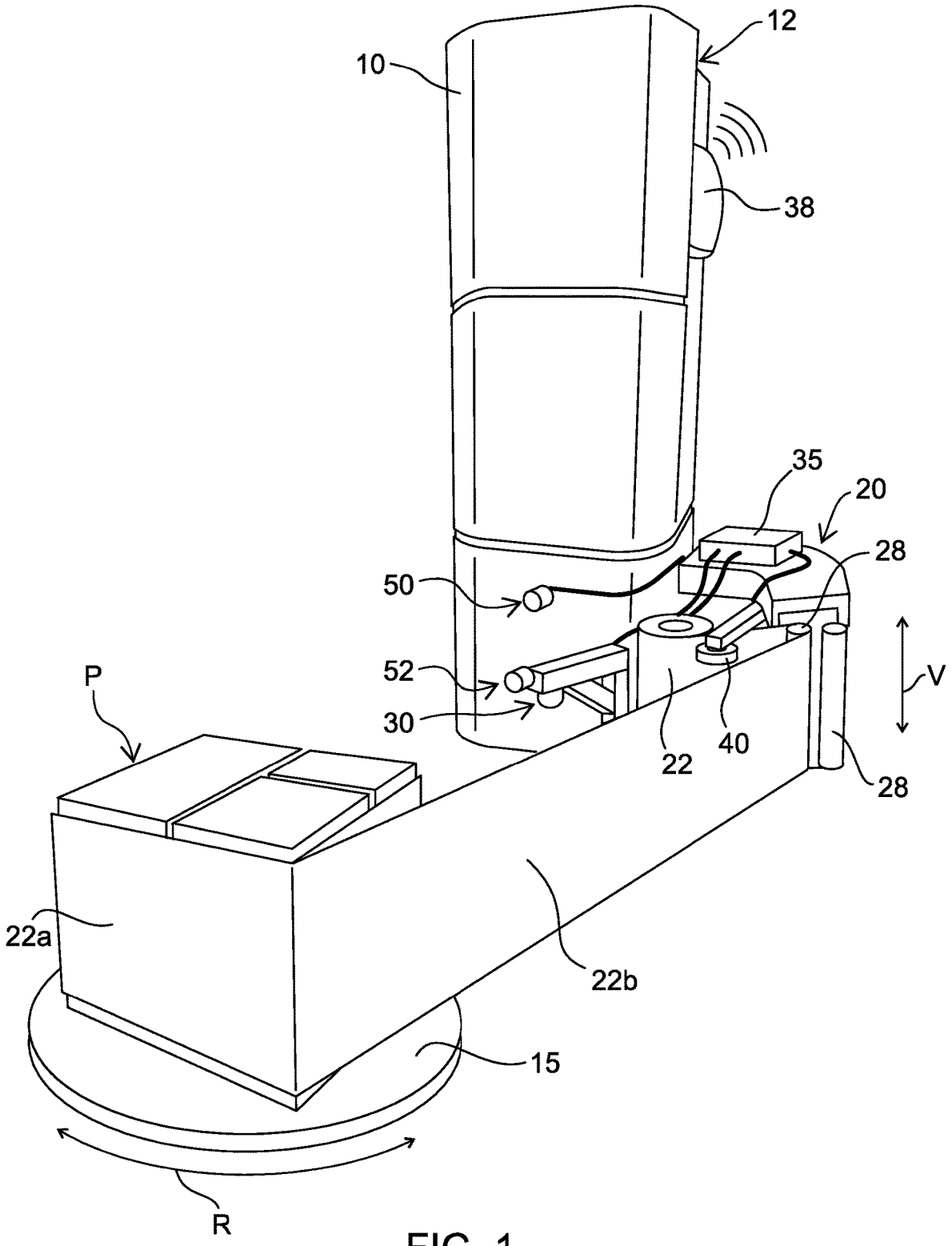
FIG. 1 is a perspective view of a stretch wrapping machine according to one aspect of the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
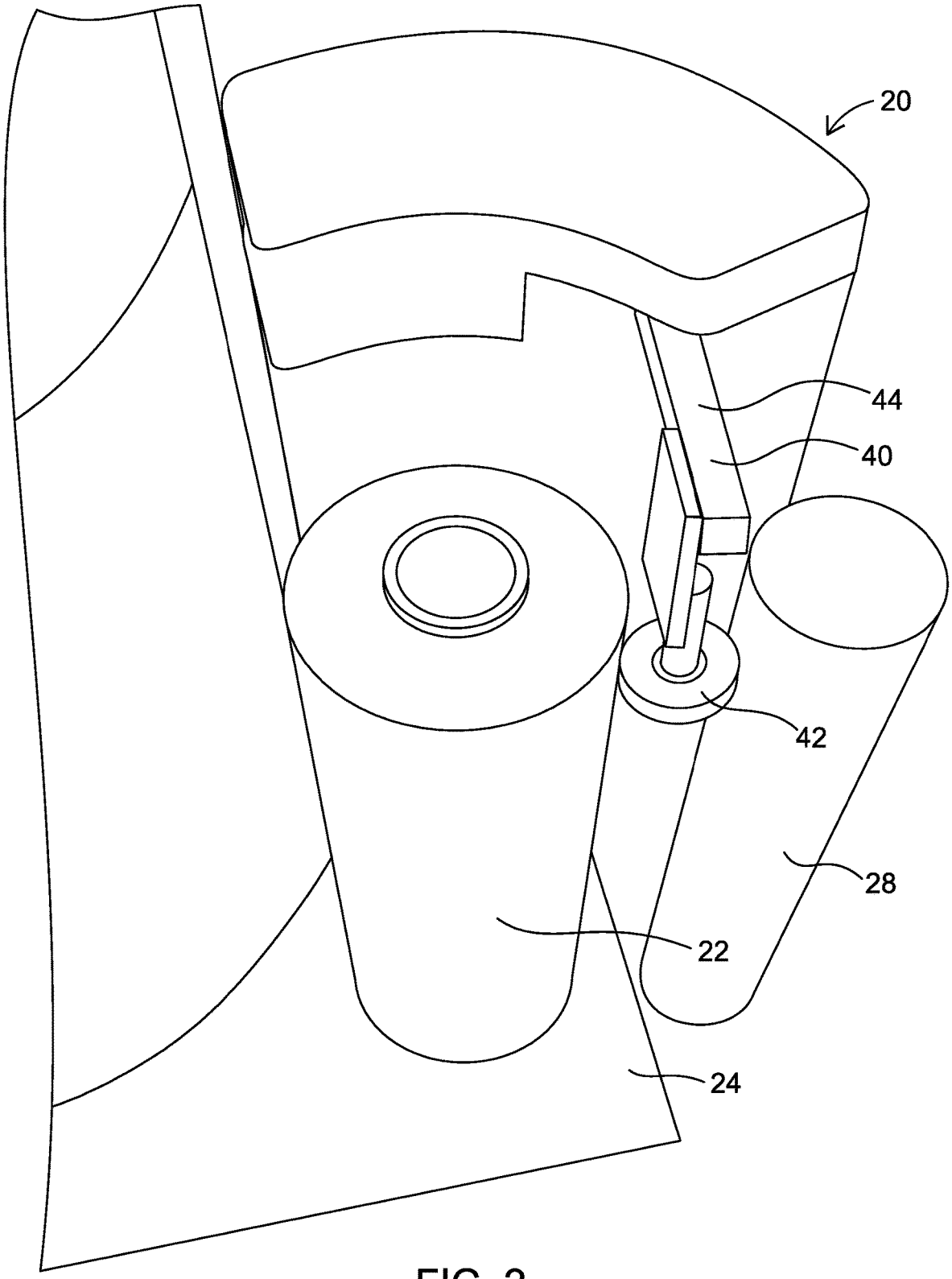
FIG. 2 is a perspective detail view of the stretch wrap dispenser mechanism according to one feature of the present disclosure.

One type of stretch wrap machine 10 is shown in FIGS. 1-2. The device 10 can be a conventional semi-automatic turntable stretch wrapper, such as the Lantech QL-400, Phoenix PLP-2150 or Highlight Predator SS. With this type of machine, the wrapping mechanism is stationary and the load rotates. However, the principles of this disclosure can be applied to other types of machine including those where the load is stationary and the wrapping mechanism rotates around the load.

The stretch wrapping machine 10 can include a turntable or rotating platform or arm 15 for supporting a palletized load P to be wrapped. The turntable 15 is configured for rotation R in at least one direction (i.e., clockwise) for winding the stretch film around the load. The machine 10 further includes a tower 12 that supports a dispenser mechanism 20 for vertical movement in the direction V. As shown in FIG. 2, the dispenser mechanism 20 includes a base 24 that supports the roll of stretch film 22. The roll may be mounted on a spindle for rotation as the film is unwound from the roll. Alternatively, the palletized load P may remain stationary and the dispenser mechanism 20 rotated around the load.

As shown in FIG. 1, the film 22 is unwound from the roll and wound around the load P so that a portion of the film 22*a* is secured to the load. The portion of the film 22*b* from the load to the dispenser mechanism 20 is maintained in tension and stretched as discussed above. The dispenser mechanism thus includes a pre-stretch roller assembly 28 that is configured or calibrated to allow for a specific percentage of stretch in the film 22*b* as it is unwound from the roller, as is commonly known in the industry. The percentage of stretch can be selected by varying rotational speeds of the pre-stretch roller assembly, in which the roller assembly is controlled by fixed or variable gearing with a belt or chain, by varying the diameters of the rollers in the assembly, or a combination of both approaches.

The tower 12 includes a drive mechanism (not shown), as known in the art, for moving the dispenser mechanism up and down during a stretch wrap process to wrap tall loads. The tower can include a height sensor (not shown) that is operable to identify the height of the load to be wrapped. The height sensor on the tower can be in the form of an electric eye operable to sense the height of the load. A controller (not shown) in the tower receives and interprets the signal from the height sensor to determine the maximum vertical travel required to wrap the entire load. The controller then controls the operation of the dispenser mechanism 20 to move the roll of film 22 vertically as it is being dispensed to ensure the film is applied in response to the height of the load as sensed by the height sensor. A height sensor 30 may also be provided as part of the dispenser mechanism 20 to identify the height of the load to be wrapped. In this embodiment, the height sensor 30 directs a signal at the loaded pallet P as the dispenser 20 is elevated along the tower 12 in order to determine the vertical limit of the load.

The present disclosure contemplates a system for use with a stretch wrapping machine that is configured to monitor the amount or percentage of stretch in the film as it is being wrapped around the loaded pallet. In one embodiment, the dispenser mechanism includes a first sensor in the form of a wheel-mounted encoder 40 having a rotating wheel 42 that bears on the outer surface of the stretch wrap roll 22, as shown in FIGS. 1-2. The wheel 42 is carried by an arm 44 that is mounted to the dispenser mechanism in a manner to ensure that the wheel 42 maintains contact with the roll as the film is dispensed. The arm 44 may thus be spring biased with sufficient pressure to maintain wheel-to-film contact even as the outer diameter of the film decreases as it is being dispensed. The wheel 42 contacts the film 22 as close to the point of passage of the film to the pre-stretch rollers 28 as possible. The wheel 42 is part of a rotary encoder that generates a first signal during rotation of the wheel indicative of the effective travel distance of the wheel. The wheel encoder is thus operable to measure the initial length of the film—that is the pre-stretched length of the film before it reaches the pre-stretch rollers. The wheel encoder 40 is connected to the controller 35 and a processor within the controller calculates the initial length of the film as it is being dispensed based on the diameter of the wheel and the degrees of rotation of the wheel.

The stretch wrapping machine 10 is further configured to determine the stretched length of the stretch film, which can be used to determine stretch percentage. A second sensor in the form of distance sensor 50 is mounted to the tower 12, and in addition or alternatively a distance sensor 52 is mounted to the dispenser mechanism 20 to move with the stretch wrap roll 22. The sensor 50, 52 is aimed at the center of the turntable 15 just above the turntable in order to sense a loaded pallet P supported on the turntable. The sensor 50, 52 may be ultrasonic, infrared, or laser-based, or any other type of sensor capable of determining the distance between the sensor and the surface of a film wrapped around the loaded pallet. In one embodiment, the sensors are time-of-flight (TOF) sensors that measure the travel time of a signal transmitted to and reflected from the film. The signal can be a laser light signal or other signal or beam capable of being reflected by the stretch wrap film. The sensor is used to measure the distance from the sensor to the pallet load and to provide a signal to the controller 35 indicative of that distance. As the pallet platform rotates during wrapping, this distance is measured continuously or intermittently and the distance data is collected and processed by the processor of the controller 35 to find the most accurate distance information from the collected data. Time related information is also sent to or determined by the processor.

The processor then compares this distance information to a known distance from the sensor 50, 52 to the center of the rotating pallet platform. The processor uses the collected distance data and the known distance from the sensor to the center of the platform to approximate the length of the circumference or perimeter of the load. The processor can also determine the rotation of the load based on the repeating measurement data, such as the repeating pattern that occurs in the distance signal as the corners and flat faces of the loaded pallet P rotate relative to the distance sensors. Once the length of the perimeter of the load is approximated, the stretched length of the stretch film for each rotation is calculated by the processor and compared to the pre-stretched length, as determined by the wheel encoder 40, to find the percentage of stretch. The pre-stretched length is known from using the diameter of the wheel encoder and the time measurements. In one example, the wheel encoder measures a length of 100 inches of pre-stretched film dispensed in a 10 second interval. The distance sensors 50, 52 and the processor of the controller 35 calculate a stretched length of 300 inches of film applied during one rotation of the loaded pallet P that occurred during that 10 second interval. The processor then determines that the film stretched 200 inches and calculates the percentage of stretch to be 200% (amount of stretch+initial length). In one embodiment, the calculation of the wrap percentage is performed for each rotation of the pallet.

Once the percentage of stretch has been calculated by the processor, this value can be compared to one or more preset threshold values for a particular stretch film product. For example, if a particular stretch film has desirable characteristics at 200% of stretch, the processor can be configured to send alerts when the percentage of stretch falls below a threshold value, for example 170%. It is understood that these numbers are for illustrative purposes only. The preset threshold values can include lower and upper percentage of stretch limits, such as 190-210% in the illustrated example. The processor compares the calculated percentage of stretch to the limits to determine if the stretch falls outside those limits. The processor can be configured to provide real-time feedback to allow maintenance or other personnel the opportunity to correct the stretch-related issues sooner. In one embodiment, the processor of the controller 35 is connected to a communication device 38 that allows the relevant data to be transmitted to a remote device, receiver or server. Such communications device can be a cellular modem, Bluetooth, Wi-Fi or any suitable enabled communications processor.

Figure 3:
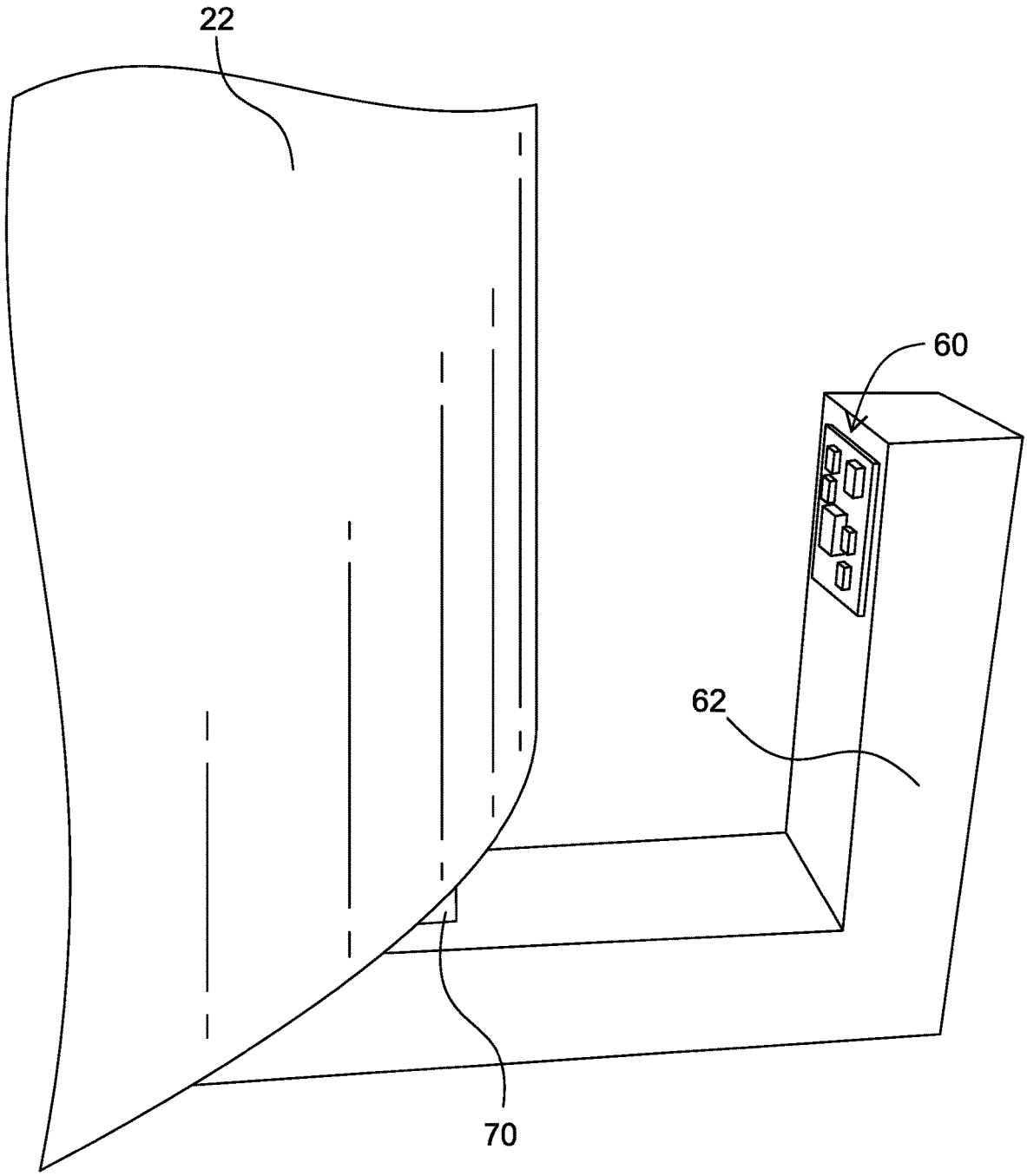
FIG. 3 is a perspective view of a sensor arrangement associated with the stretch wrap roll according to one embodiment of the present disclosure.

In a further embodiment of the stretch wrapping machine incorporates other mechanisms for determining the pre-stretch length of the film in lieu of the wheel encoder 40. In particular, the mechanism is contactless, meaning that contact with the film is not required as with the wheel encoder. In the embodiment illustrated in FIG. 3, the first sensor includes a time-of-flight (TOF) sensor 60 and a proximity detector 70 that are supported on a bracket 62 mounted to the platform 24 supporting the stretch wrap roll 22. The TOF sensor is arranged to measure the time of flight of a signal or beam emitted by the sensor and reflected from the surface of the film. As the film is unwrapped from the roll 22 the radius of the roll decreases and the time-of-flight of the sensor signal increases. The TOF sensor 60 provides a time-of-flight signal to the processor of the controller 35 and the processor calculates a measured length, L_Measured in FIG. 4, from that signal. The radius of the roll at any instant in time is the difference between a calibration length to the center of the roll 22, namely L_Cal in FIG. 4.

Figure 5:
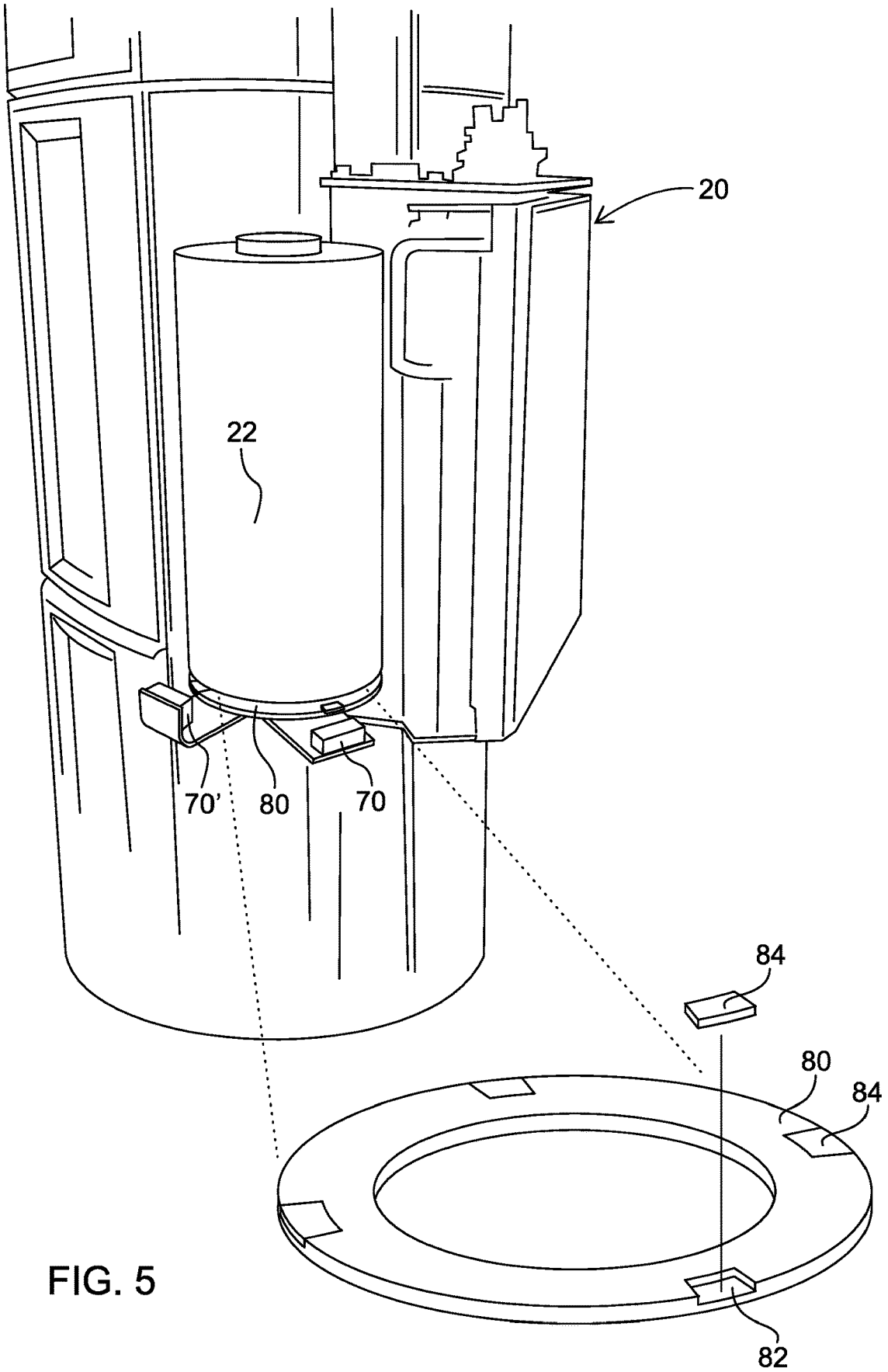
FIG. 5 is a perspective view of the dispenser mechanism of FIG. 2 incorporating a ring for supporting the stretch wrap roll.

The rotation rate of the stretch wrap roll 22 can be determined by the proximity sensor 70. The proximity sensor 70 may be a Hall effect sensor that generates a signal each time that a magnet or metallic element passes by the sensor. In one embodiment, the stretch wrap roll 22 is carried by a ring 80 that rotates with the roll, as illustrated in FIG. 5. The ring 84 can include one or more metallic elements or magnets disposed in pockets or notches 82 at uniform angular positions around the ring so that the actuation of the proximity sensor 70 can be used to find the rate and amount of rotation of the roll. The proximity sensor 70 provides a signal to the processor and the processor uses that signal with the signal from the TOF sensor to determine the circumferential length of travel for a known time interval based on the calculated radius and upon the change in radius as the film is deployed from the roll. It is noted that the proximity sensor may be disposed underneath the roll 22 and ring 80, such as the sensor 70, or may be situated radially outboard of the roll and ring, such as the sensor 70'.

Figure 6:
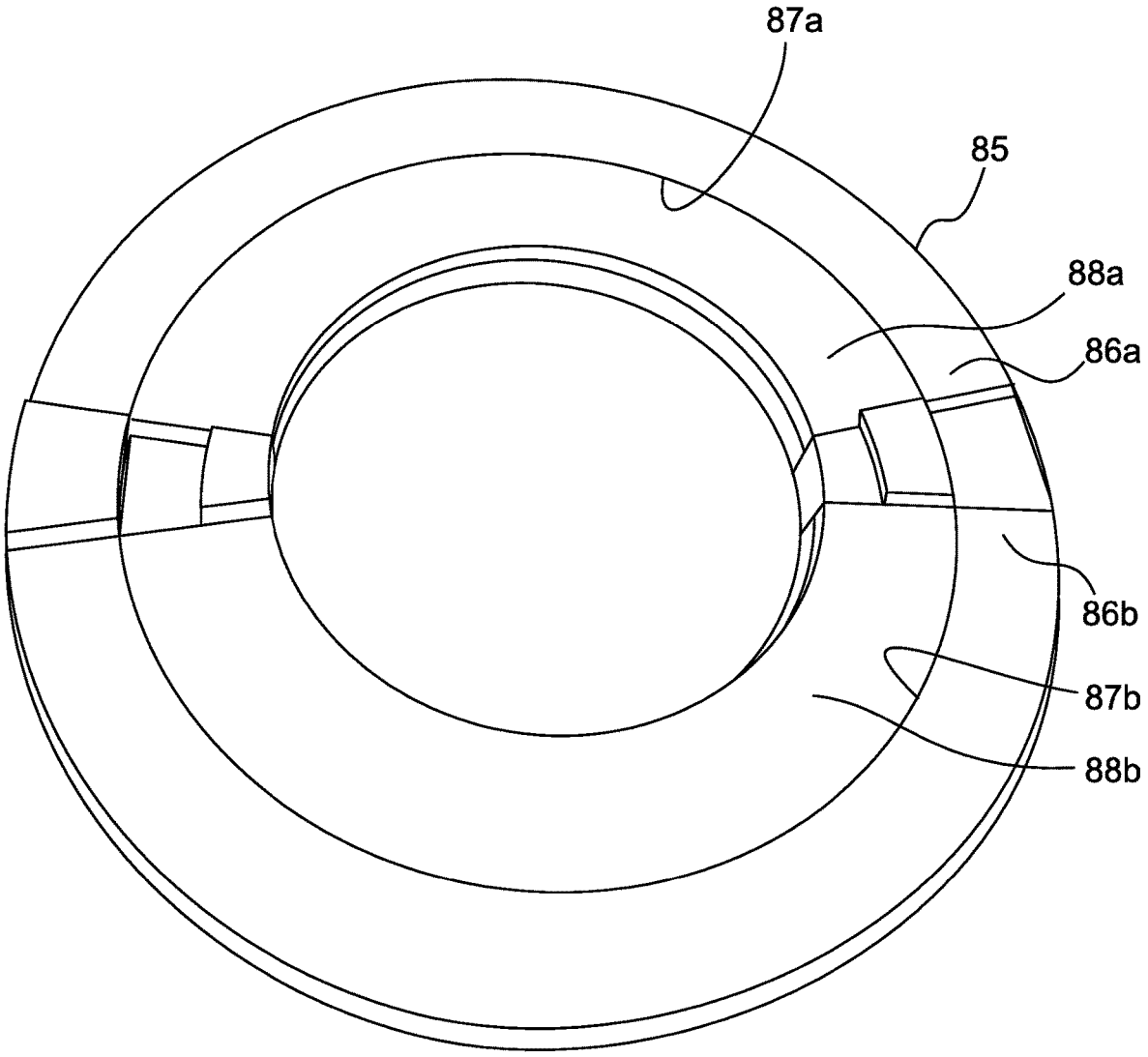
FIG. 6 is an enlarged view of another embodiment of a ring for supporting the stretch wrap roll.
Figure 7:
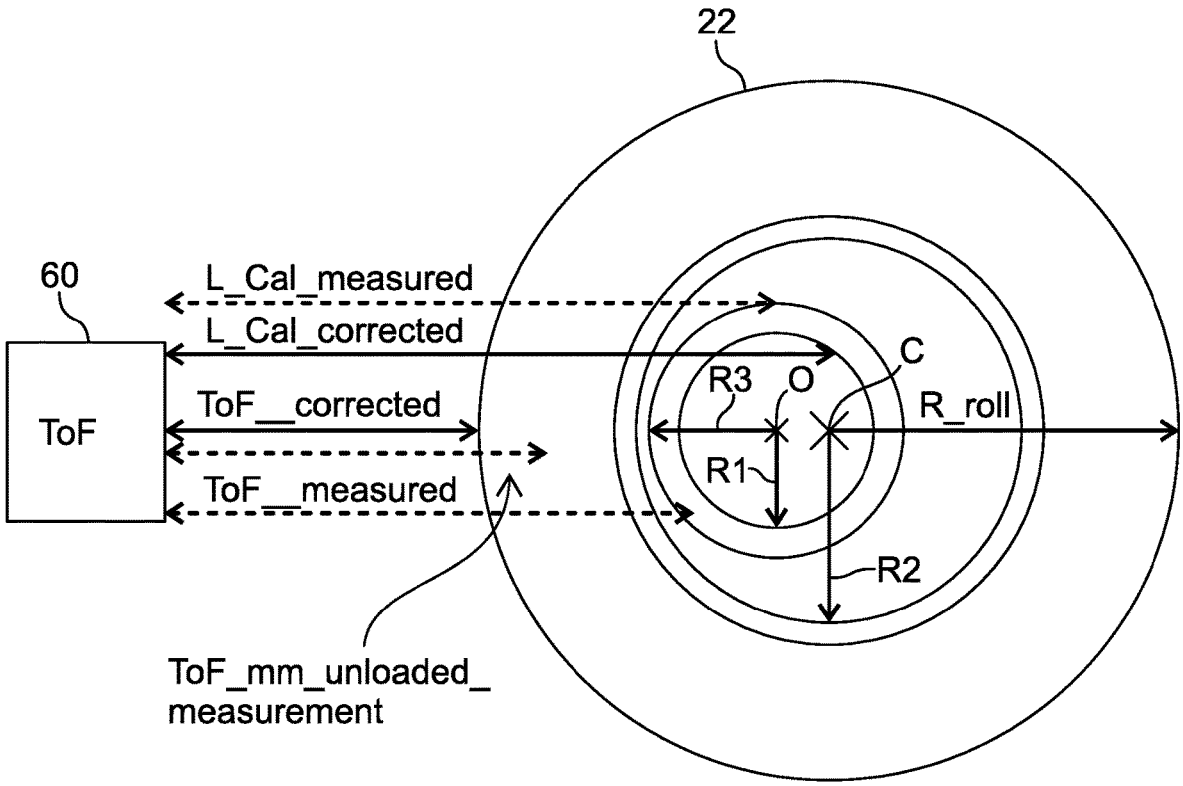
FIG. 7 is a diagram illustrating potential errors in the length calculation implemented by the processor.

A ring 85 depicted in FIG. 6 may be used to support the roll 22 in the manner shown in FIG. 5. In this embodiment, the ring 85 includes two interlocking half-rings 86*a*, 86*b* that can be combined to form a continuous ring. The ring 85 defines a recessed portions 87*a*, 87*b* that receives a friction elements 88*a*, 88*b*. The friction elements are formed of a high-friction material so that the roll 22 seated on the elements 88*a*, 88*b* does not slide on the ring 85. In one embodiment, the friction elements 88*a*, 88*b* may be in the form of neoprene pads embedded within recessed portions 87*a*, 87*b*. The half-rings 86*a*, 86*b* that combine to form the ring 85 can be formed of a low-friction material, such as a plastic, that can easily slide on the platform 24 supporting the roll 22. As with the ring 80, the ring 85 can incorporate magnets or metallic elements within pockets at uniform angular positions around the ring.

Figure 4:
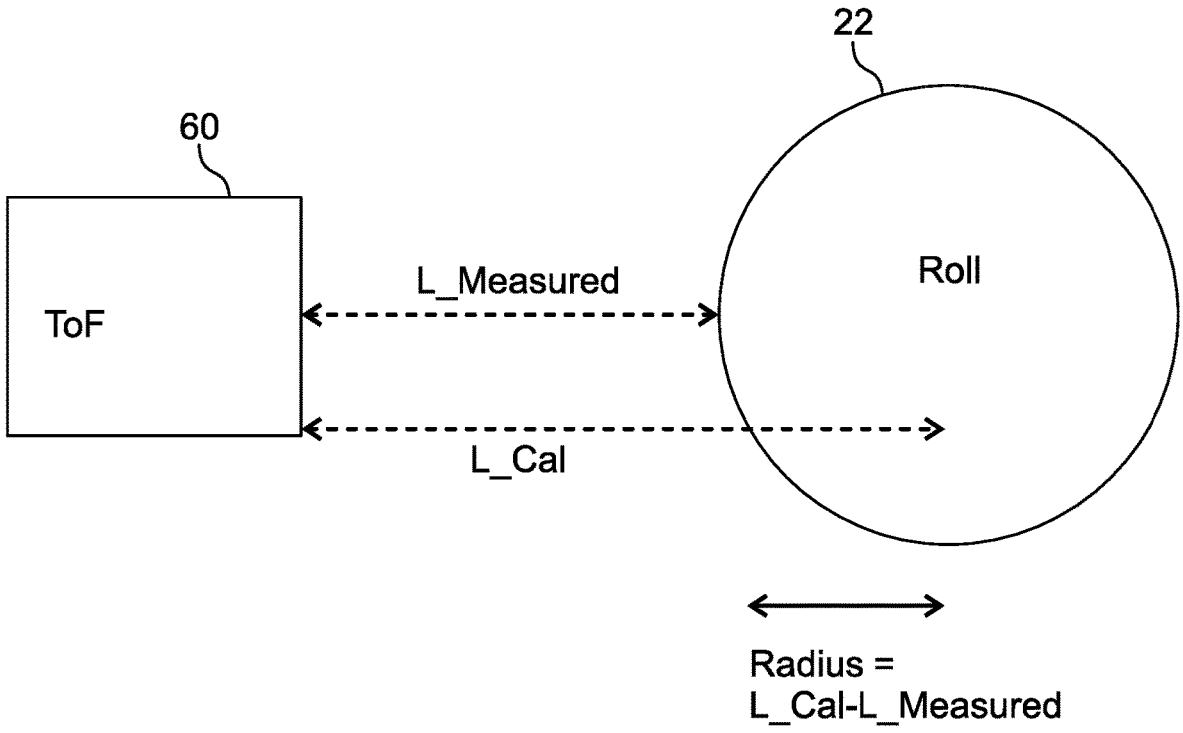
FIG. 4 is a diagram of a length calculation implemented by the processor of the stretch wrapping machine disclosed herein.

The radius calculation represented in the diagram of FIG. 4 is an idealized representation. However, it is known that certain materials have absorption properties such that the materials will absorb the signal generated by the TOF sensor, and in particular a laser light signal used by the TOF sensor. Thus, as shown in FIG. 5, a time-of-flight measurement by the sensor 60 can result in a measured distance, ToF_measured, that is inside the roll 22. For a common stretch wrap material, the material will "absorb" the laser light signal to a depth of about 0.2 inches. The processor thus adjusts the measured distance, ToF_corrected, by the known depth of absorption to produce a corrected distance that corresponds to the actual surface of the roll. The absorption characteristics of various stretch wrap films can be maintained in a data base of the processor and accessed as needed to calculate the corrected time-of-flight. The absorption characteristics can be readily determined experimentally by directing a TOF sensor to a roll of stretch wrap film having a known radius. This process can be implemented on the dispenser mechanism 20 with each new roll of film loaded into the mechanism, with the controller actuating a calibration process.

As depicted in FIG. 5, it is also known that in some stretch wrapping machines the center of rotation of the roll 22 can have some "slop" so that the measured calibration length (L_Measured) to the center of rotation of the roll may be incorrect. In the circumstance illustrated in FIG. 5, the measured calibration length has the center of rotation offset to position O from its true location at position C. This offset would result in a calculated radius of the roll that is less than the actual radius of the roll. Consequently, the calibration length is corrected to L_Cal_corrected so that the correct roll radius can be determined. This correction can be determined by the proximity sensor 70 configured to measure any eccentricity in the rotational path of the roll 22. The amount and direction of eccentricity can be used to calculate the corrected calibration length L_Cal_corrected.

The processor in the controller 35 is configured and operable to execute program instructions to translate the signals from the sensors 40, 50, 52, 60, 70 to the data required to determine the percentage of stretch in the stretch wrap film from the time that it leaves the roll 22 to the time that it wrapped around the pallet load P. The processor and program instructions thus convert the signal from the first sensor, in the form of the wheel encoder, to a distance traveled value corresponding to the length of the film. In the alternative embodiment, the processor and program instructions convert the signal from the first sensor in the form of the TOF sensor 60 to a value for the distance from the sensor to the film at each instant of time. The processor executes program instructions to determine the radius of the roll at each instant of time and then calculate the length of film leaving the roll over a time interval. The processor and program instructions further convert the signal from the second sensor(s) 50, 52 to the distance from the second sensor to the wrap around the pallet load P, and then calculate the length of the film wrapped around the load over the time interval.

The processor then executes program instructions to calculate the difference between the length of the film before the pre-stretch roller assembly and the length of the wrapped around the pallet load, and calculate the percentage stretch of the film. The processor can then execute program instructions to compare this calculated percentage of stretch to a pre-determined threshold value to determine whether the film stretch is outside a preferred operating range. The processor can then be configured to generate an alarm sensible by a machine operator or maintenance personnel, and/or to transmit an alert with or without accompanying data. It is further contemplated that the processor can control the dispenser mechanism and/or the rotating platform or arm supporting the load The foregoing description of one or more embodiments of the stretch wrap machine has been presented herein by way of example and not limitation. It will be recognized that there are advantages to certain individual features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations, or improvements therein may be subsequently made by those skilled in the art, which are also intended to be encompassed by the appended claims.

What is claimed is:

1. A stretch wrapping machine for wrapping a stretch wrap film around a load, the machine comprising:

a dispenser mechanism supporting a roll of stretch wrap film and including a pre-stretch roller assembly for receiving the film from the roll and guiding the film to the load to be wrapped around the load supported thereon;

a first sensor associated with the roll and configured to generate a first signal as the film travels from the roll to the pre-stretch roller assembly, wherein the first sensor is a time-of-flight sensor for measuring the distance between the first sensor and the film on the roll;

a second sensor associated with the load and configured to generate a second signal as the film is wrapped around the load; and a processor configured and operable to;

receive said first signal and calculate a pre-stretch length of the film based on said first signal during a time interval;

receive said second signal and calculate a stretched length of the film as the film is wrapped around the load during the time interval, calculate a percentage of stretch of the film based on said pre-stretch length and said stretched length; and generate a sensible output based on the calculated percentage of stretch, wherein the processor is configured and operable to determine a radius of the film on the roll and to calculate the pre-stretch length of the film based on the radius.

2. The stretch wrapping machine of claim 1, wherein:

the time-of-flight sensor emits a signal or beam directed toward the film on the roll;

the film on the roll has absorption properties for the signal or beam emitted by the sensor; and the processor is further configured and operable to determine a corrected distance between the first sensor and the film on the roll to correct for absorption properties of the film on the roll.

3. A stretch wrapping machine for wrapping a stretch wrap film around a load, the machine comprising:

a dispenser mechanism supporting a roll of stretch wrap film and including a pre-stretch roller assembly for receiving the film from the roll and guiding the film to the load to be wrapped around the load supported thereon;

a first sensor associated with the roll and configured to generate a first signal as the film travels from the roll to the pre-stretch roller assembly;

a second sensor associated with the load and configured to generate a second signal as the film is wrapped around the load, wherein the second sensor is a distance sensor and said second signal is indicative of the distance between said second sensor and the load; and a processor configured and operable to;

receive said first signal and calculate a pre-stretch length of the film based on said first signal during a time interval;

receive said second signal and calculate a stretched length of the film as the film is wrapped around the load during the time interval, calculate a percentage of stretch of the film based on said pre-stretch length and said stretched length; and generate a sensible output based on the calculated percentage of stretch, wherein the processor is configured and operable to calculate a length of the film wrapped around the load in the time interval, wherein the length corresponds to the stretched length.

4. A system associated with a stretch wrapping machine for monitoring the percentage stretch of a stretch wrap film as it is wrapped around a load by the stretch wrapping machine, the stretch wrapping machine including a dispenser mechanism supporting a roll of stretch wrap film and including a pre-stretch roller assembly for receiving the film from the roll and guiding the film to the load to be wrapped around the load, said system comprising:

a first sensor associated with the roll and configured to generate a first signal as the film travels from the roll to the pre-stretch roller assembly, wherein the first sensor is a time-of-flight sensor for measuring the distance between the first sensor and the film on the roll;

a second sensor associated with the load and configured to generate a second signal as the film is wrapped around the load; and a controller including a processor configured and operable to;

receive said first signal and calculate a pre-stretch length of the film based on said first signal during a time interval;

receive said second signal and calculate a stretched length of the film as the film is wrapped around the load during the time interval, calculate a percentage of stretch of the film based on said pre-stretch length and said stretched length; and generate a sensible output based on the calculated percentage of stretch, wherein the processor is configured and operable to determine a radius of the film on the roll and to calculate the pre-stretch length of the film based on the radius.

5. The system of claim 4 wherein:

the time-of-flight sensor emits a signal or beam directed toward the film on the roll;

the film on the roll has absorption properties for the signal or beam emitted by the sensor; and the processor is further configured and operable to determine a corrected distance between the first sensor and the film on the roll to correct for absorption properties of the film on the roll.

6. A system associated with a stretch wrapping machine for monitoring the percentage stretch of a stretch wrap film as it is wrapped around a load by the stretch wrapping machine, the stretch wrapping machine including a dispenser mechanism supporting a roll of stretch wrap film and including a pre-stretch roller assembly for receiving the film from the roll and guiding the film to the load to be wrapped around the load, said system comprising:

a first sensor associated with the roll and configured to generate a first signal as the film travels from the roll to the pre-stretch roller assembly;

a second sensor associated with the load and configured to generate a second signal as the film is wrapped around the load, wherein the second sensor is a distance sensor and said second signal is indicative of the distance between said second sensor and the load; and a controller including a processor configured and operable to;

receive said first signal and calculate a pre-stretch length of the film based on said first signal during a time interval;

receive said second signal and calculate a stretched length of the film as the film is wrapped around the load during the time interval, calculate a percentage of stretch of the film based on said pre-stretch length and said stretched length; and generate a sensible output based on the calculated percentage of stretch, wherein the processor is configured and operable to calculate a length of the film wrapped around the load in the time interval, the length corresponding to said stretched length.

* * * * *